US006032557A

United States Patent [19]

Anderson

[11] Patent Number: 6,032,557

[45] **Date of Patent: *Mar. 7, 2000**

[54] DRIVER TOOL KIT WITH HIGH ENERGY MAGNETIZER/DEMAGNETIZER ON TOOL HANDLE(S)

[76] Inventor: Wayne Anderson, 65 Grove St., Northport, N.Y. 11729

[ * ] Notice: This patent is subject to a terminal disclaimer.

[21] Appl. No.: 09/144,813

[22] Filed: Sep. 1, 1998

[51] Int. Cl.[7] ..... B25B 23/08

[52] U.S. Cl. ..... 81/451; 81/125

[58] Field of Search ..... 81/125, 451; 7/125

[56] References Cited

U.S. PATENT DOCUMENTS

| | | |
|---|---|---|
| 512,381 | 1/1894 | Keyes . |
| 608,555 | 8/1898 | Nazel . |
| 1,587,647 | 6/1926 | Hood et al. . |
| 1,619,744 | 3/1927 | McCloskey . |
| 2,174,327 | 9/1939 | Love . |
| 2,260,055 | 10/1941 | Reardon . |
| 2,300,308 | 10/1942 | Ojalvo . |
| 2,624,223 | 1/1953 | Clark . |
| 2,630,036 | 3/1953 | Brown . |
| 2,653,636 | 9/1953 | Younkin . |
| 2,666,201 | 1/1954 | Van Orden . |
| 2,671,369 | 3/1954 | Clark . |
| 2,671,484 | 3/1954 | Clark . |
| 2,677,294 | 5/1954 | Clark . |
| 2,678,578 | 5/1954 | Bonanno . |
| 2,688,991 | 9/1954 | Doyle . |
| 2,718,806 | 9/1955 | Clark . |
| 2,720,804 | 10/1955 | Brown . |
| 2,750,828 | 6/1956 | Wendling . |
| 2,758,494 | 8/1956 | Jenkins . |
| 2,782,822 | 2/1957 | Clark . |
| 2,793,552 | 5/1957 | Clark . |
| 2,834,241 | 5/1958 | Chowning . |
| 3,007,504 | 11/1961 | Clark . |
| 3,126,774 | 3/1964 | Carr et al. . |
| 3,253,626 | 5/1966 | Stillwagon, Jr. et al. . |
| 3,320,563 | 5/1967 | Clark . |
| 3,392,767 | 7/1968 | Stillwagon, Jr. . |
| 3,467,926 | 9/1969 | Smith . |
| 3,630,108 | 12/1971 | Stillwagon, Jr. . |
| 3,662,303 | 5/1972 | Arllof . |
| 3,707,894 | 1/1973 | Stillwagon, Jr. . |
| 3,869,945 | 3/1975 | Zerver . |
| 3,884,282 | 5/1975 | Dobrosielski . |
| 4,219,062 | 8/1980 | Berkman . |
| 4,393,363 | 7/1983 | Iwasaki . |
| 4,827,812 | 5/1989 | Markovetz . |
| 5,000,064 | 3/1991 | McMahon . |
| 5,038,435 | 8/1991 | Crawford et al. . |
| 5,178,048 | 1/1993 | Matechuk . |
| 5,210,895 | 5/1993 | Hull et al. . |
| 5,259,277 | 11/1993 | Zurbuchen . |
| 5,577,426 | 11/1996 | Eggert et al. . |
| 5,794,497 | 8/1998 | Anderson ..... 81/451 |

FOREIGN PATENT DOCUMENTS

| | | |
|---|---|---|
| 869431 | 5/1961 | United Kingdom . |

*Primary Examiner*—James G. Smith

*Attorney, Agent, or Firm*—Lackenbach Siegel Marzullo & Aronson

[57] ABSTRACT

A hand-held driving tool kit includes a plurality of hand-held driving tools each having an elongate handle which defines a tool axis and is suitably shaped and dimensioned to be graspable within the hand of the user. The driving tool may be in the form of a fixed, precision or other drivers in which the driver members, such as flat blade and Phillips screwdriver tips are mounted at one axial of the handle. The handle defines a driver axis generally coaxially aligned with the tool axis. At least one of said driving tools of said kit having at least one permanent magnet is provided on the handle, the magnet being formed of a magnetized material having north and south poles defining a magnetic axis generally arranged on the handle to permit selective placement of a magnetizable element at at least one position along the magnetic axis at a predetermined distance from one of the poles to magnetize the element and placement of the element a distance greater than such predetermined distance of the other of the poles to demagnetize the element. The magnetic axis is either aligned with or offset from the driver axis. In this way, a magnetizable element may be magnetized by positioning same adjacent to one of the poles and demagnetized by positioning the magnetizable element adjacent the other of the poles. The magnets used have an energy product equal to at least $7.0\times10^6$ gauss-oersteds. Although the magnets may be embedded within the handle, the magnets may be oriented in relation to the surfaces of the handle or a hole within the handle to facilitate placement of the part to be magnetized very closely to the magnetizing pole and somewhat more distantly positioned in relation to the demagnetizing pole. The kit allows each of the driving elements to be magnetized and/or demagnetized with a limited number of permanent magnets mounted on the handle(s) of at least one of the driving tools of the kit.

21 Claims, 7 Drawing Sheets

DRIVER TOOL KIT WITH HIGH ENERGY MAGNETIZER/DEMAGNETIZER ON TOOL HANDLE(S)

BACKGROUND OF THE INVENTION

1. Field of the Invention

The present invention generally relates to tools, and more specifically to a driver tool kit with at least one driver tool of the kit having an elongate handle which embodies high energy magnetizer/demagnetizer permanent magnets for selectively magnetizing and/or demagnetizing a magnetizable element, such as a driver bit, fastener, and the like.

2. Description of the Prior Art

It is frequently desirable to magnetize the tips of screwdriver bits, tweezers and the like to form at a least temporary magnetic pole on the tool which attracts magnetizable elements. Thus, particularly with precision screwdrivers which tend to be relatively small and are used to drive relatively small screws, it is frequently advantageous to at least temporarily magnetize the screwdriver tips of the driver bits to maintain the screwdriver tip blade within the slot of a head of a screw or a Phillips driver within the cross slots formed within the head of the screw adapted to receive the Phillips screwdriver tip. By magnetizing the tip of the driver bit, and mating the tip within the associated opening in the head of the screw, the screw remains attached to the bit tip without the need to physically hold them together. This allows the screw to be guided through a relatively small bore or channel and moved within confined spaces. Sometimes the magnetized tip of the driver bit is used to retrieve a metal item, such as a screw, washer, nail or the like, from an inaccessible place which would otherwise be difficult to reach with anything but a relatively thin shank of a bit driver. Of course, such attachment of a fastener to the driver bit tip also frees one hand for holding or positioning the work into which the fastener is to be driven. In some instances, rather than magnetizing the tip of the driver member bit, the fastener itself is magnetized so that, again, it is attracted to and remains magnetically attached to the driver bit tip in the same way as if the latter had been magnetized.

Conversely, there are instances in which a magnetized driver bit tip is a disadvantage, because it undesirably attracts and attaches to itself various magnetizable elements or components. Under such circumstances, it may be desirable to demagnetize a driver bit tip that had been originally magnetized in order to render same magnetically neutral.

Devices for magnetizing/demagnetizing tools and small parts are well known. These normally incorporate one or more permanent magnets which create a sufficiently high magnetic field to magnetize at least a portion of a magnetizable element brought into its field. The body can be magnetized by bringing it into the magnetic field. While the magnetic properties of all materials make them respondent in some way to magnetic fields, most materials are diamagnetic or paramagnetic and shown almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Hard materials are used to supply fixed fields either to act alone, as in a magnetic separator, or interact with others, as in loudspeakers, electronic instruments and test equipment.

Most magnetizers/demagnetizers include commercial magnets which are formed of either Alnico or of ceramic materials. The driver members/fasteners, on the other hand, are normally made of soft materials which are readily magnetized but more easily lose their magnetization, such as by being drawn over an iron or steel surface, subjected to a demagnetizing influence such as strong electromagnetic fields or other permanent magnetic fields, severe mechanical shock or extreme temperature variations.

One example of a magnetizer/demagnetizer is magnetizer/demagnetizer Model No. 40010, made in Germany by Wiha. This unit consists of a plastic box that has two adjacent openings defined by three spaced transverse portions. Magnets are placed within the transverse portions to provide magnetic fields in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided with progressive steps to stepwise decrease the air gap for the demagnetizing field and, therefore, provides different levels of strengths of the demagnetizing field. However, common magnetic materials that are used with conventional magnetizers/demagnetizers include Alnico and ceramic magnets which typically have energy products equal to approximately $4.5\times10^6$gauss-oersteds and $2.2\times10^6$ gauss-oersteds, respectively.

Since the magnetic field strength "B" at the pole of the magnet is a product of the unit field strength and the area, it follows that the energy content is proportional to the BH product of the magnet. The BH product is a quantity of importance for a permanent magnet and is probably the best single "figure of merit" or criterion for judging the quality of the permanent magnetic material. It is for this reason that conventional magnetizers/demagnetizers have required significant volumes of magnetic material to provide the desired energy content suitable for magnetizing and demagnetizing parts. However, the required volumes have rendered it impossible or impractical to incorporate the magnetizers/demagnetizers on relatively small hand tools. Thus, for example, precision screwdrivers, which are relatively small and have relatively small diameter handles, could not possibly incorporate sufficient magnetic material to provide desired levels of magnetic fields for magnetizing and demagnetizing parts. However, the requirement of using separate magnetizer/demagnetizer units has rendered their use less practical. Thus, unless the user of a precision screwdriver or any driver tool acquired a separate magnetizer/demagnetizer, one would not normally be available for use. Additionally, even if such magnetizer/demagnetizer were available, it would still require a separate component that could be misplaced and not be available when needed. Of course, there is always the risk that the magnetizer/demagnetizer could become misplaced or lost, rendering the use of the driver tool less useful.

SUMMARY OF THE INVENTION

It is an object of the present invention to provide a combination driver tool kit with at least one driver tool of the kit having at least one magnet for providing a magnetizing field proximate to the handle, even for small precision screwdrivers, to allow a driver bit or magnetizable component to be magnetized.

It is another object of the present invention to provide such a combination driver tool kit as aforementioned which provides sufficiently strong magnetic fields to effectively and adequately magnetizing/demagnetizing a driver bit and/or a magnetizable component.

It is still another object of the present invention to provide a combination driver tool kit as in the previous objects in which the magnetizing and demagnetizing fields are created proximate to the surface of the handle.

It is yet another object of the present invention to provide a tool as in the previous objects in which the handle is provided with one or more openings within the handle in which the magnetizing and/or demagnetizing fields are formed for convenient and reliable magnetization and/or demagnetization.

It is a further object of the invention to provide a driver tool kit of the type above suggested in which at least one of the driver tools has a magnet for providing a magnetizing field proximate to the handle and at least one of the driving tools has a magnet for providing a demagnetizing field to be used by the other driving tools of the kit.

It is still a further object of the present invention to provide a driver tool kit as in the previous object in which the magnetizing and demagnetizing magnets may be placed on the same tool driver of the kit or on different drivers of the kit.

It is yet a further object of the present invention to provide a self-contained driver tool kit consisting of a plurality of driver tools in which most of the driver tools of the kit can be magnetized and/or demagnetized by using magnets provided on at least one of the driver tool handles. Preferably, the energy product of the permanent magnetic material is equal to at least $7.0 \times 10^6$ gauss-oersteds.

In order to achieve the above objects, as well as others which will become apparent hereinafter, a combination driving tool kit in accordance with the present invention has a plurality of hand-held driving tools each having an elongate handle defining a tool axis and being suitably shaped and dimensioned to be graspable within the hand of a user. A driver member, such as a screwdriver bit, Phillips bit, or the like is mounted at one axial end of said handle and defines a driver axis generally co-axially aligned with said tool handle. At least one of said driving tools of said kit has at least one permanent magnet provided on said handle, having north and south poles defining a magnetic axis arranged on said handle of said at least one driving tool to permit selective placement of a magnetizable element at at least one position generally along said magnetic axis at a predetermined distance from one of said poles to magnetize the element and placement of the element a distance greater than said predetermined distance from the other of said poles to demagnetize the element. Said magnetic axis may be either aligned with or offset from said driver axis. In this way, driver members of at least some of the driving tools or a magnetizable element may be efficiently magnetized by positioning such element adjacent to one of said poles and demagnetized by positioning the magnetizable element adjacent to the other of said poles.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
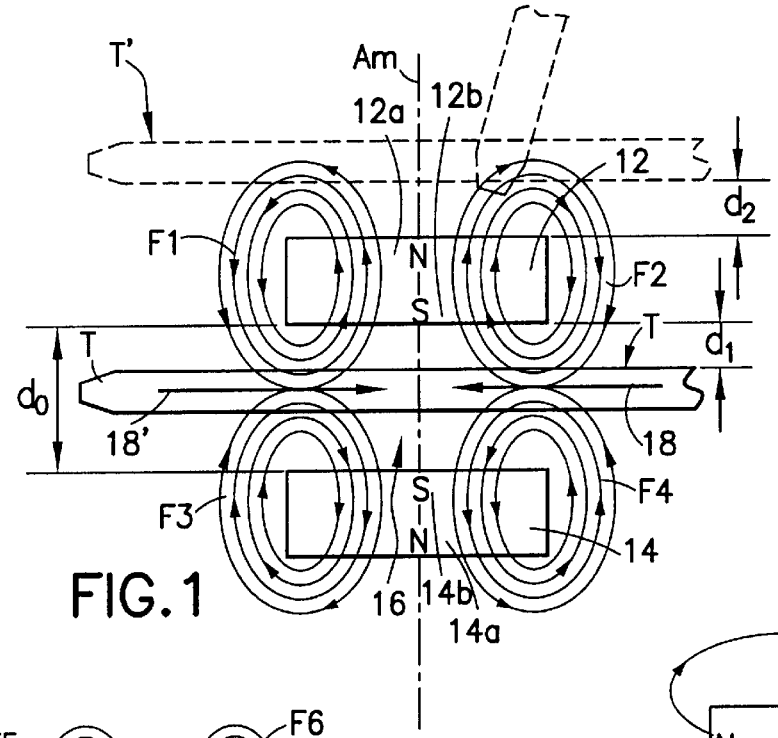
FIG. 1 is a schematic representation of the magnetic fields in the vicinity of two spaced magnets generally aligned along their magnetic axes, and showing a shank of a driver tool such as a screwdriver shank, passed through the space between the magnets, in solid outline, to magnetize the shank, and also showing, in dashed outline, the same driver shank positioned adjacent to an opposite the pole, to demagnetize the shank.

Referring now specifically to the FIGS., in which identical or similar parts are designated by the same reference numerals throughout, and first referring to FIG. 1, an arrangement of magnets to be used to achieve the objects of the present invention is generally designated by the reference numeral 10. The arrangement includes two spaced magnets 12, 14 spaced from each other a distance $d_0$ such that the magnetic poles of the two magnets are generally aligned with each other along a magnetic axis $A_m$. In FIG. 1, the poles facing each other are the same or similar poles, in the example shown these being south poles "S". Because similar poles of magnets repel each other, it will be evident that the resulting magnetic fields surrounding these magnets will be as depicted in FIG. 1, fields F1 and F2 being diametrically opposing cross sections of a generally continuous field in the shape of a torus surrounding the upper magnet 12 and symmetrically arranged about the magnetic axis $A_m$. Similarly, fields F3 and F4 are cross sectional images of a correspondingly shaped toroidal field symmetrically arranged about the magnetic axis $A_m$ in relation to the lower magnet 14. In the presently preferred embodiments, the magnets 12, 14 are "pill" magnets in the shape of circular cylindrical discs, the axes of symmetry of which coincide along the magnetic axis $A_m$. However, it will be evident to those skilled in the art that the specific shapes of the "cylinders" are not critical and discs having configurations other than circular discs may be used, with different degrees of advantage.

The spaced magnets 12, 14 create a region 16 between these magnets in which the upper and lower fields reinforce each other in the region 16 to produce magnetic components 18, 18' that are radially inwardly directed at diametrically opposite sides of the fields, as shown in FIG. 1. It will be evident, therefore, that a tool T inserted into the space 16 will experience localized fields that are significantly stronger than the fields generated by either one of the magnets and will be roughly twice the strength of the fields generated by either one of the magnets. Additionally, while the idealized representation in FIG. 1 suggests that the magnetic field will be enhanced or magnified only about the peripheries of magnets 12, 14, it will also be evident that an enhanced field will also be generated throughout the space 16.

With a field configuration as depicted in FIG. 1, it will be evident that the insertion of an elongate shank "T" of a driver, such as a screwdriver, drill bit, etc., into the space 16 will experience field reversals as the shank is introduced radially, in relation to the axis $A_m$, from one side of the magnets, through the axis $A_m$ and ultimately out through the diametrically opposite side. In the example illustrated, if a screwdriver is initially inserted from the right-hand side, as viewed in FIG. 1, the tip portion T1 of the driver shank T will initially experience the component 18 which is directed toward the left. As that portion T1 of the shank approaches the magnetic axis $A_m$ (at T2), the magnetic field is relatively neutral, or virtually nonexistent. When the portion T1 of the tool shank passes towards the left through the fields F1 and F3 it will experience a magnetic component 18' and generally directed towards the right. At the same time, an upstream portion T3 of the shank, passing through the fields F2, F4 will experience the component 18 toward the left. If the shank T does not proceed further towards the right than illustrated in FIG. 1, there will be upstream portions of the shank, beyond T3, that will not experience the strong magnetic forces created by the magnets 12, 14. As a result of the reversals of the directions of the magnetic fields by the components 18, 18', it will be evident that different portions of the shank T will initially be magnetized in one direction and be subsequently magnetized in an opposing direction. Such reversals in magnetization will continue as the shank T moves through the composite field towards the left when the tool is initially introduced between the magnets, and ultimately moved towards the right when the tool is withdrawn from the space 16. It will also be evident that although the tip T1 of the shank T will initially be magnetized when it is introduced into the space 16 from the right, it will also be the last portion of the shank T to be magnetically altered as it is the last portion to be withdrawn from the space 16 as the tool shank T is moved towards the right.

As will be more fully discussed in connection with FIG. 8, since the magnetic components 18, 18' are extremely strong, the last magnetic component that acts on any portion of the shank will demagnetize any previously magnetized portion and may, depending on the parameters, remagnetize that magnetizable portion consistent with the directions of the magnetic components. In FIG. 1, since the magnetic component 18 is the last component to be experienced by the tip T1 of the driver shank, the removal of that tip portion from the space 16 by movement of the shank towards the right will cause the magnetic component 18 to magnetize the tip T1 with a north pole "N". Therefore, the strong magnetic field within the space 16 will strongly magnetize the tip T1 of the shank T. To demagnetize the tip, when desired or necessary, requires that the tip T1 of the shank be placed within a field in which the field lines are reversed within the tip portion so that the field lines enter instead of leave the tip portion. This can be done by swiping or passing the tip portion T' across an opposite pole, here along the north pole "N" of the upper magnet 12. When the shank T is swiped adjacent the north pole N, as illustrated in dashed outline at T', and the shank is moved from left to right, it will be evident that the upper part of the field F2 will flow in the desired direction within the tip of the driver to effectively demagnetize that tip, in whole or in part, or remagnetize it with an opposing polarity. For reasons which will be more fully discussed in connection with FIG. 8, one feature of the present invention consists of the relative spacings $d_1$, $d_2$ of the driver shank from the initial magnetizing pole "S" and from the demagnetizing pole "N", respectively, such that magnetization of the tool will be assured and efficient, while demagnetization will be substantially complete while avoiding remagnetization with an opposing polarity. As will be evident from the discussion of FIG. 8, the magnetic force required to magnetize a magnetizable material is significantly greater than the magnetic force required to demagnetize that material. A feature of the invention, therefore, is the arrangement of the magnet or magnets in such a way that will position the shank T of the tool to be magnetized closer to the magnetizing pole face than to the demagnetizing pole face. In FIG. 1, this can be established by selecting the distance $d_1$ to be smaller than the distance $d_2$. While the specific distances $d_1$ and $d_2$ are not critical, they should be selected to generally correspond to the magnetizing and demagnetizing forces required to magnetize and demagnetize a specific tool shank T, this being a function both of the size of the shank as well as the specific material from which it is made. The material is important because, as will be evident from FIG. 8, different materials exhibit different magnetic properties, requiring different magnetic intensities or magnetizing forces to produce the same magnitudes of magnetic field or magnetic flux. The dimensions of the material to be magnetized is also important, because the more volume that the tool shank exhibits, the greater the magnetic field that will be required since what is instrumental in magnetizing or demagnetizing the material is not only the absolute intensity of the magnetic field but also the relative density of the field taken across a given cross sectional area of the tool or magnetizable material. In the case of the shank of a screwdriver, for example, the larger the diameter of the shank, the smaller the relative density of the magnetic field for a given amount of available magnetic flux. Therefore, in order to magnetize or demagnetize magnetic materials that are not saturated generally requires magnetic field levels consistent with the geometric dimensions of the shanks.

Figure 1A:
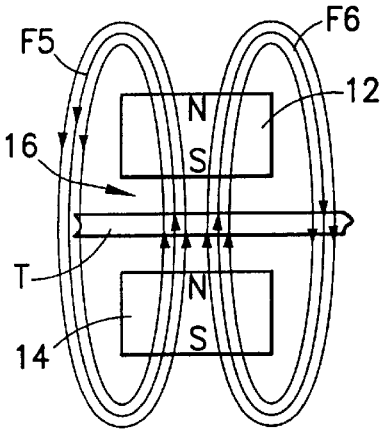
FIG. 1A is generally similar to FIG. 1, but showing a schematic representation of the magnetic fields when the two spaced magnets have their opposing poles facing each other.

In FIG. 1A, a different field configuration is established in the space 16. By flipping the magnet 14 around by 180°, the positions of the poles "N" and "S" are reversed, so that opposite poles now face each other across the gap of the space 16. Since the facing poles now attract, an enlarged field is formed including diametrically opposite sections F5, F6 of a toroidal field symmetrically arranged about the magnetic axis $A_m$. It will be clear that the field components that pass through the tool shank T are essentially perpendicular to the shank instead of being parallel as in FIG. 1. Whle there will be a number of field reversals as the shank T passes through the space 16, as viewed in FIG. 1A, the magnitude and orientations of the field have less of a magnetizing influence on the tool shank, and the arrangement is less effective than the arrangement shown in FIG. 1.

Figure 1B:
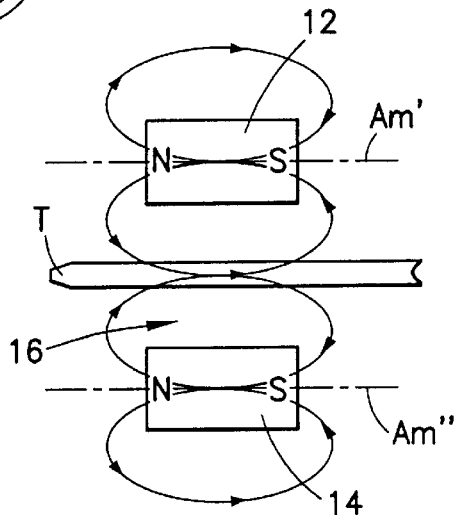
FIG. 1B is an alternative arrangement of the two spaced magnets in which similar poles face the same directions and the two magnetic axes are spaced but substantially parallel to each other.

In FIG. 1B, the two magnets 12, 14 are arranged so that their magnetic axes $A_m'$, $A_m''$ are parallel but offset from each other. The resulting field is similar in some respects to the field shown in FIG. 1, in which each magnet generates its own magnetic field, both fields reinforcing each other in the space 16 through which the tool shank T is passed. However, the field does not reverse as the shank passes through the space and continues to magnetize the shank in the same sense or polarity both when inserted as well as when withdrawn from the space 16. While the embodiment shown in FIG. 1 has been found to be most effective, the embodiments shown in FIGS. 1A and 1B may be used with different degrees of advantage.

Figure 2:
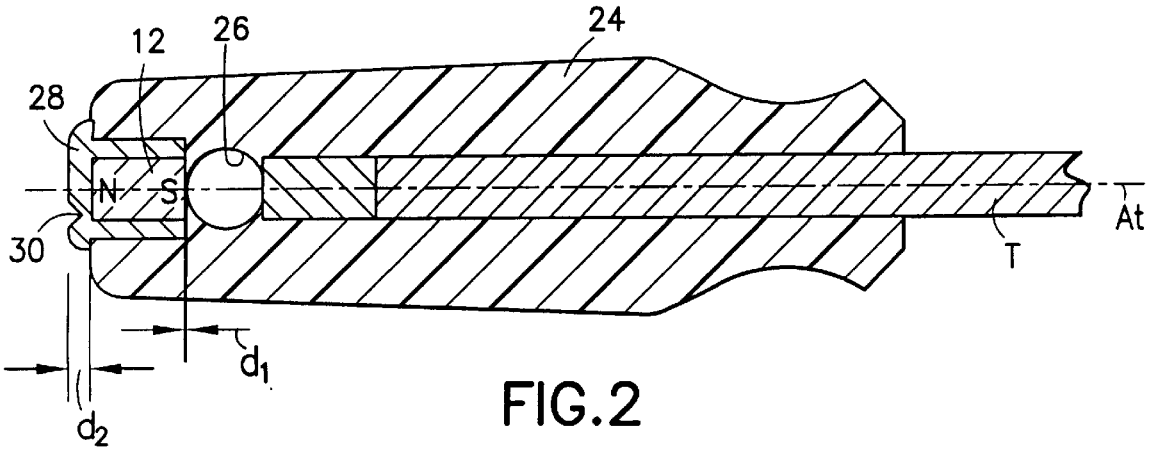
FIG. 2 is a cross sectional view of a driver handle illustrating one presently preferred embodiment of the invention, in which a hole is provided within the driver handle and two spaced magnets arranged with their magnetic axes generally aligned or co-extensive with the axis of the driver tool shank and handle and spaced on opposite sides of the hole.

In FIG. 2, a cross sectional view is shown of one embodiment of the present invention, in which the spaced magnets 12, 14 are generally aligned with the tool axs $A_t$ or axis of the handle 14. In order to provide the equivalent of the space 16 in FIG. 1, a hole 26 is formed in the handle 24 between the magnets 12, 14, such that the tool shank S of a driver tool can be passed through the hole initially through one side and out through the other side of the hole, and subsequently withdrawn from that hole to simulate the action described in connection with FIG. 1. As in FIG. 1, the poles of the magnets 12, 14 facing the hole 26 are both the same, south poles "S" in the example shown. It should be clear, however, that the poles may be reversed so that the north poles "N" face each other across the hole 26.

While the magnet 16 is embedded deep within the handle 26, proximate to the shank T, the other magnet 12 is positioned proximate to the free end of the handle 24, an end cap or cup-shaped cap or cover 28 being provided to enclose or encapsulate and cover the magnet 12 to prevent it from being damaged, as well as serving as a spacer to maintain a desired demagnetizing spacing $d_2$. The cap or cover 28 is preferably made of a nonmagnetizable material, such as aluminum. Other materials, such as plastic, may also be used.

To ensure that the magnetizing fields are substantially greater than the demagnetizing fields, the distance $d_1$ is normally selected to be smaller than the distance $d_2$, for reasons aforementioned. If desired, a notch 30 may be formed in the cap or cover 28 to facilitate the positioning or locating of a shank of a driver tool during demagnetization, for consistent results.

The tool 22 is but one example of the type of tools in connection with which the present invention may be used. The tool 22 is shown as a "fixed" shank driver, in which the shank T is permanently embedded and fixed within the handle 24. Accordingly, the shank T of the tool 22 cannot be magnetized as contemplated by the present invention by the magnets mounted within the handle 24 that supports the same shank. The magnets 12, 14, in this case, can be used to magnetize the shank or shanks of other driver tools that could be readily inserted into the hole 26. To magnetize the shank T of the tool 22 shown in FIG. 2, therefore, that shank would need to be inserted into a corresponding magnetizer arrangement of another driver tool.

As will also be evident from FIGS. 1 and 2, a feature of the invention is that the magnets are so arranged that the magnetizable element or component to be magnetized can be positioned, or swiped across the magnetic axis $A_m$ of the magnets both during magnetization and demagnetization. While the magnetizable component is preferably positionable along the magnetic axis both during magnetization and demagnetization, it will normally suffice if such component can be positioned or swiped proximate to such magnetic axis. Thus, in FIG. 1, the tip T" of the magnetizable shank is shown positioned slightly offset from the magnetic axis $A_m$. In some instances, such offset in the positioning of the magnetizable portion to be demagnetized is desirable in order to either increase the magnetic field, in the case of larger magnetizable objects, or to decrease the demagnetizing field, in the case of smaller magnetizable objects. As explained in connection with FIG. 1, the field conditions with the arrangement shown in FIG. 1 generally provides very much reduced magnetic field intensities along the magnetic axis itself, although the field increases rapidly, slightly "off center." The notch 30 in FIG. 2 can, therefore, be provided as a guide to the user for purposes of positioning the magnetized component at a desired location to provide effective demagnetizing fields. In FIG. 2, as well, the distance $d_1$ is less than the distance $d_2$ to take advantage of the characteristics of the magnetic fields required for magnetization and demagnetization of any given magnetizable component.

In FIGS. 3–7, the invention is shown as applied or used in conjunction with kits in which one or magnetizing/demagnetizing elements are used in conjunction with a plurality of drivers, most of which can be magnetized and/or demagnetized using the limited number of magnets on at least one of the tools of the kit. In FIGS. 3A–3F, on illustrative kit is shown in which the tools of the kit employ multi-bit elements interchangeably supportable within reversible sleeves which can receive such multi-bit elements and which are themselves receivable within the handle of the kit. In FIGS. 3A and 3B, two multi-bit elements 32, 32' are shown. The element 32 is a dual bit element which includes a hex support shaft 34'. One driver shaft 36 supporting a flat screwdriver blade 38 extends from one axially end of the hex support shaft 34 while another driver shaft 40 providing a Phillips screwdriver tip 42 extends in the opposite axial direction. Similarly, the dual bit element 32' in FIG. 3B is similar to the element 32 in FIG. 3A except that the diameters of the driver bit shafts 36' and 40' are larger than those in FIG. 3A, resulting in a larger flat screwdriver blade 38' and a larger Phillips driving head 42'. Each of the hex support shafts 34 may include a conventional spring loaded ball detent 46. In FIG. 3C a sleeve 48 is shown which has separate open ended channel 50, 52 opening in opposite longitudinal or axial directions and being dimensioned to selectively receive a hex or support shaft 34. Such 4-in-1 sleeve is described in U.S. Pat. No. 5,711.194, issued to the applicant of the subject patent invention. The sleeve 48 includes a conventional airs 54 which protrude beyond the exterior surface of the sleeve 48 and which are receivable within diametrically opposite slots in a handle 58 of the type shown in FIG. 3D. The handle 58 preferably includes conventional ribs 60 or other surface finish to allow to user to grip the handle and minimize slipping during use of the tool. In FIGS. 3E and 3F, two handles 58' and 58" are shown which may be similar to the handle 58 shown in FIG. 3B. However, in FIG. 3E the handle is shown to be provided with spaced magnets 12, 14, arranged on opposite sides of an opening or space 16, for reasons described above. In FIG. 3F, a single magnet 12 is arranged near the axial end of the handle opposite to axial end in which the sleeve 48 is received, the single magnet 12 serving as a magnetizing element, while the magnets 12, 14, in FIG. 3E can both magnetize an element when extended or passed the space 16 and demagnetized when placed proximate to the axial end of the handle 58' in the field of the magnet 12. It will be clear, therefore, that with only on handle 58', which permits magnetization and/or demagnetization or one handle 58", which provides magnetization only, a plurality of multi-bit elements 32, 32', etc., can be magnetized and/or demagnetized with a limited number of magnets permanently mounted on one or two handles. In this way, a separate magnetizer/demagnetizer need not be employed, since the magnets on the handles 58' and 58" can serve the same function.

Figure 4:
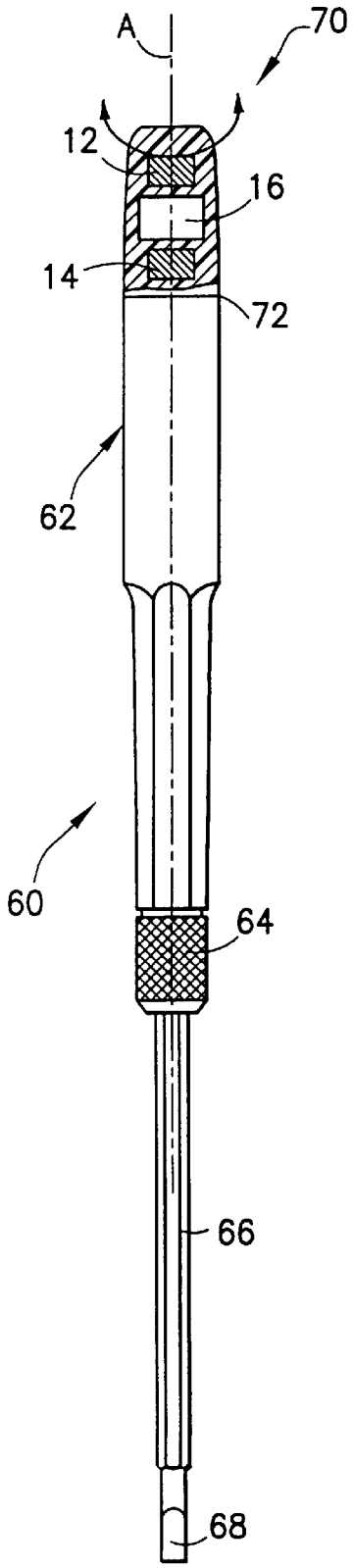
FIG. 4 is a front elevational view of a precision screwdriver for use with interchangeable driver members and provided with two spaced magnets that can be used to magnetizer/demagnetize a driver member before or after same is mounted in the operative position shown.

In FIG. 4, a precision screwdriver 60 is shown, which includes a handle 62 and a chuck 64 for releasably securing a driver bit shaft 66. In the example shown in FIG. 6, the driver shaft 66 bears a flat screwdriver blade 68 at the free end thereof. However, it should be clear that the handle 62 can be used to support a plurality of driver bit shafts exhibiting a multitude of terminations. To the extent, therefore, that the precision screwdriver 60 is normally provided with a provided with a plurality of screwdriver tips that can interchangeably be mounted on the handle 62, it constitutes a kit, each of the screwdriver bits of which can be magnetized and demagnetized. The handle 62, as shown, includes an axial end 70 which also includes magnets 12, 14, that are spaced from each other to create a space or opening 16, as described above. As is typical with precision screwdrivers, the proximate end 70 is rotatably mounted on the remaining part of the handle about axis A at the parting line 72 (as indicated by the double arrow head). The precision screwdriver 60 may be used in a conventional manner, except that when a particular driver bit is to be used, it can first be magnetized and/or demagnetized by passing the tip on one side of the magnet 12 (through the opening or space 16) or on the other side thereof as described.

Figure 5A:
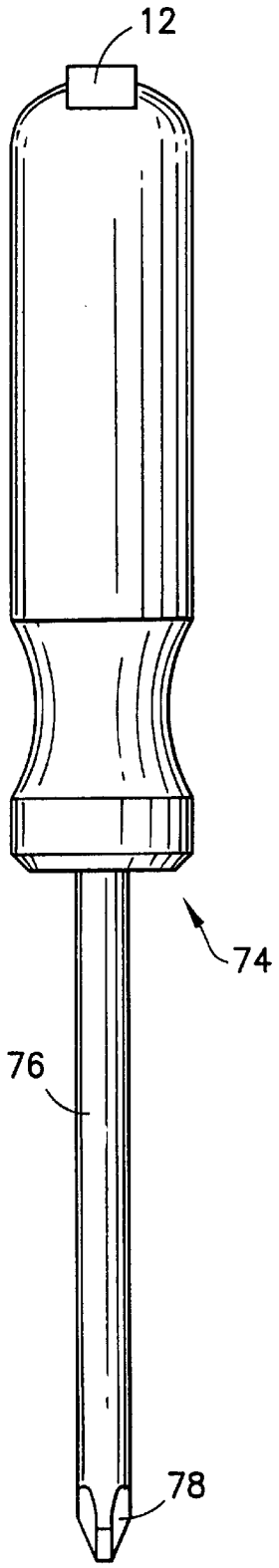
FIGS. 5A–5E illustrate another kit of hand-held driving tools in accordance with the invention, in which the driver members are fixed on the handles, two of which include magnetizing/demagnetizing permanent magnets.
Figure 5B:
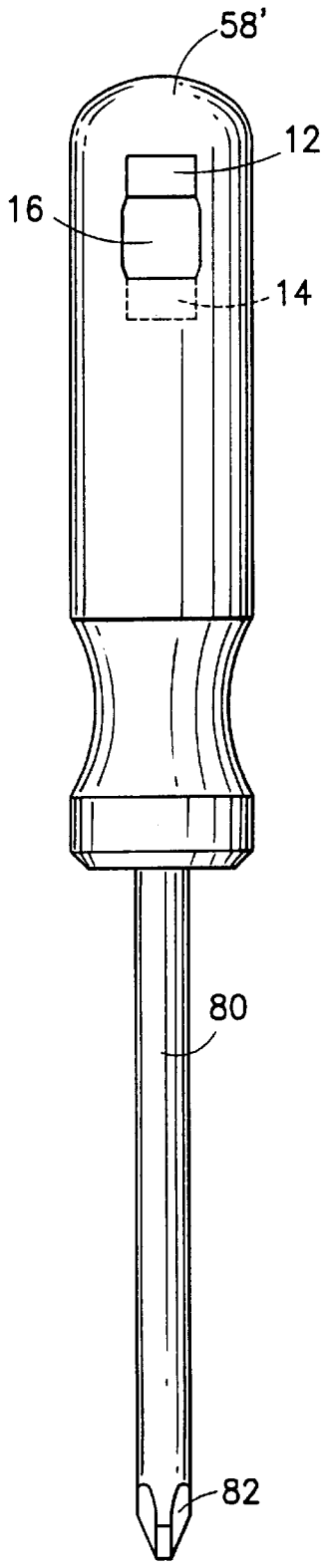
Figure 5C:
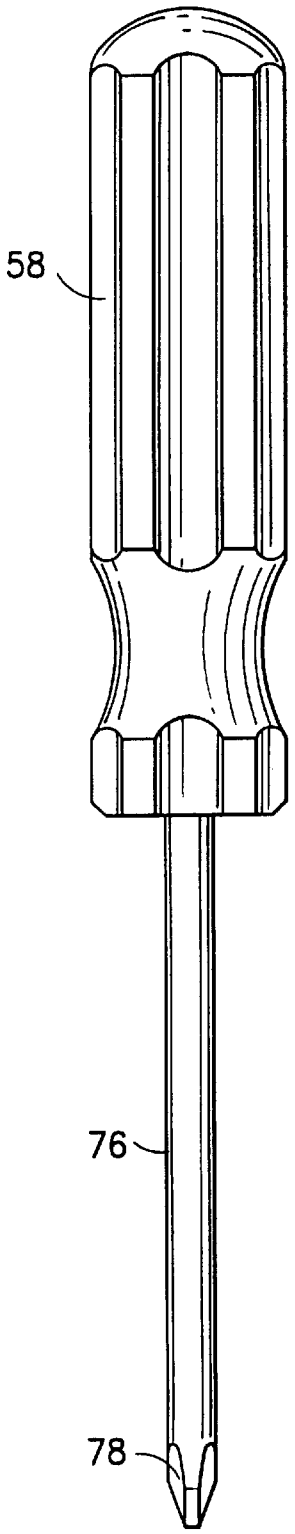

Another driver tool or kit in accordance with the present inventions is shown in FIGS. 5A–5E. This kit includes fixed drivers permanently mounted on their respective handles, instead of being interchangeable, as with the kit shown in FIGS. 3A–3F. In FIG. 5A, the screwdriver 74 forming part of the kit is mounted on a handle 58" similar to the handle shown in FIG. 3F, in which a single magnet 12 is mounted at the very end of the handle. Such magnet 12, as indicated, serves primarily to magnetize a driver bit or fastener. The handle 58" supports a fixed driver shaft 76 bearing a driver tip 78 in the form of a Phillips head. In FIG. 5B, another tool of the kit includes a handle 58' similar to the handle shown in FIG. 3E, which supports a fixed shaft 80, the end of which is a Phillips tip or head 82. In FIG. 5C, a similar screwdriver of the kit is shown which does not, however, include any magnets, while the screwdrivers of the kit shown in FIGS. 5D and 5E include handles 58*a*, 58*b*, respectively. The handle 58*a* fixedly supports a driver shaft 84 at the end of which there is provided a "TORX" tip 86, while the handle 58*b* supports a fixed shaft 88 provided at the free end thereof with another size of "TORX" tip 90. In contrast to the kit shown in FIGS. 3A–3F, in which the multi-driver bits 32, 32', can always be removed from an associated shaft or sleeve 48 to be magnetized and/or demagnetized by magnets 12, 16, the fixed driver shafts in the kit of FIGS. 4A–5E cannot be removed. In such a kit, it is desirable to have at least two of the handles of the kit including magnets, so that the fixed shafts attached to the handles which include a magnet can themselves be magnetized and/or demagnetized using the magnets mounting on another handle of the kit. While the tip 78 of the screwdriver shown in FIG. 5A can be magnetized and/or demagnetized by the magnets 12, 14, on the handle 58' in FIG. 5B, it is clear that the driver tip 82 cannot be so magnetized and demagnetized with the kit shown. The tip 82 can only be magnetized using the magnet 12 on the screwdriver shown in FIG. 5A For this reasons, it may be desirable to provide dual magnets 12, 14, as shown in FIG. 5B, on at least two of the driver handles so that all the driver tips may be magnetized and demagnetized. In the alternative, the kit may include a second screwdriver which has the same driver tip or termination as is provided on the tool of the kit which includes the dual magnets, so that every tip or termination of the kit can be used by magnetizing and demagnetizing the same.

Figure 3F:
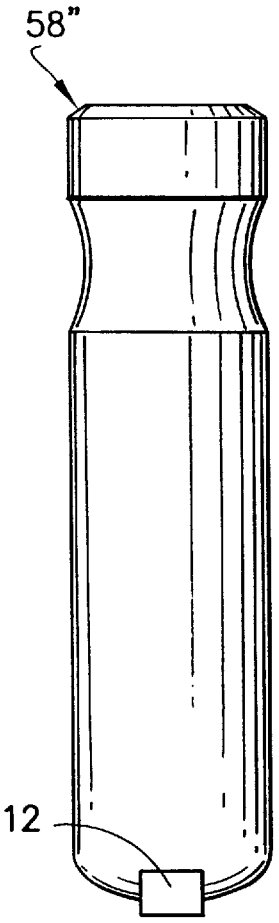
FIGS. 3A–3F illustrate one kit of hand-held driving tools in accordance with the invention, in which the driver members are multi-bit elements interchangeably supportable within a 4-in-1sleeve receivable within a plurality of handles two of which include magnetizing/demagnetizing permanent magnets.
Figure 3E:
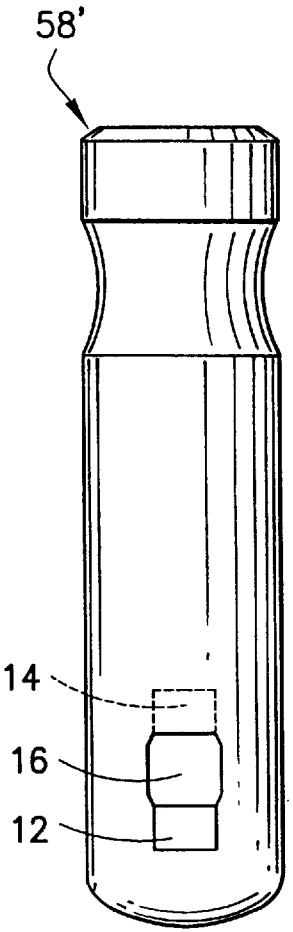
Figure 3D:
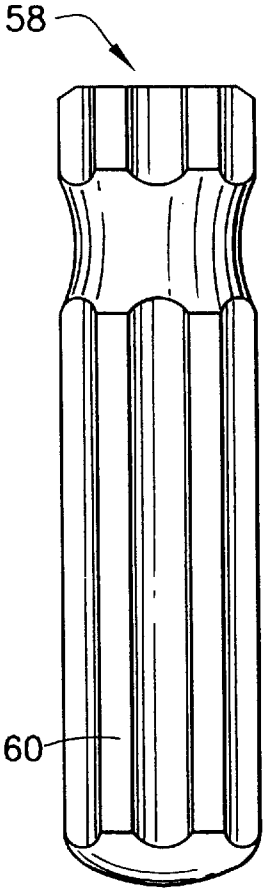
Figure 3C:
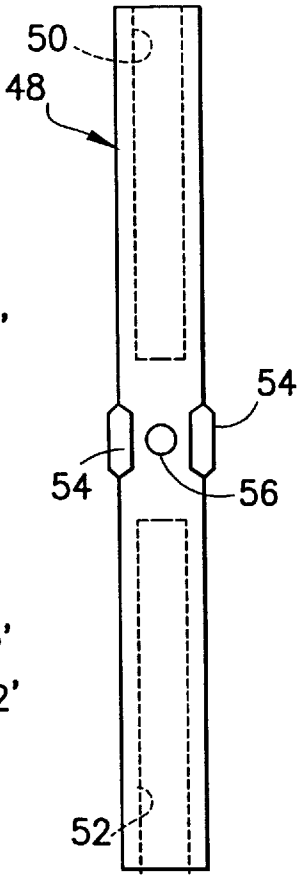
Figure 3B:
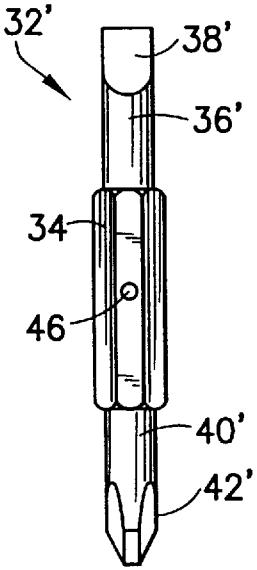
Figure 3A:
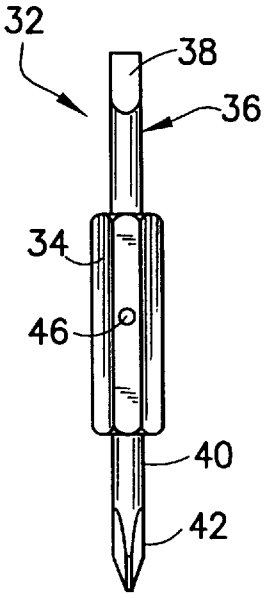
Figure 5D:
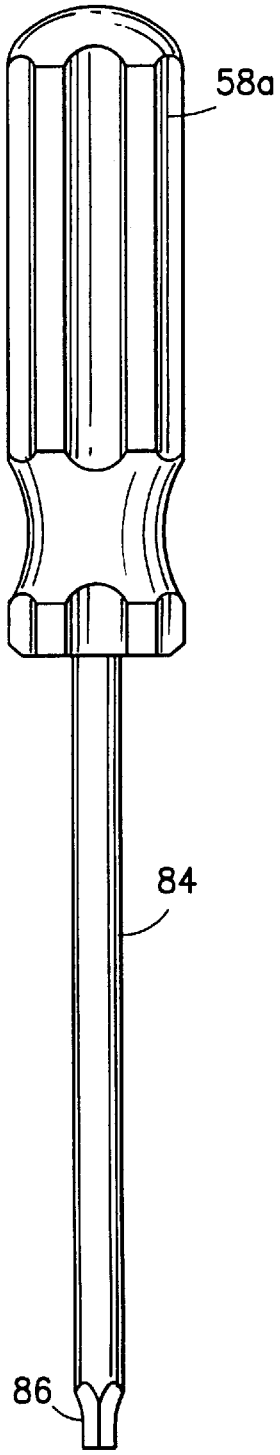
Figure 5E:
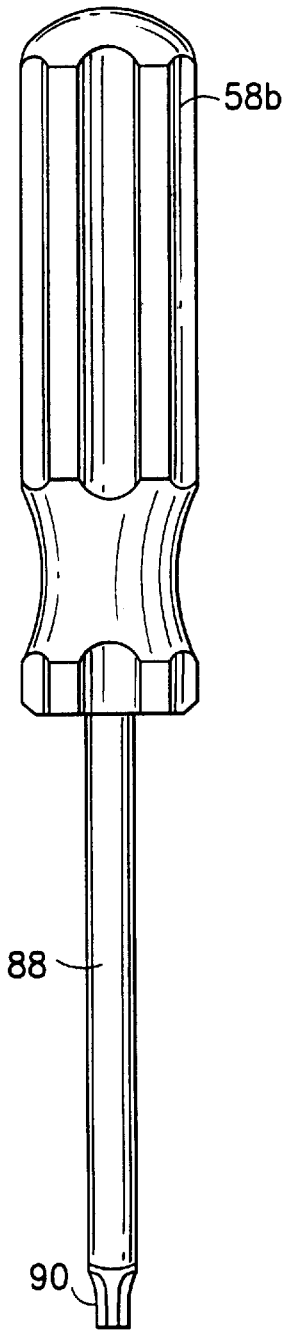
Figures 6, 7:
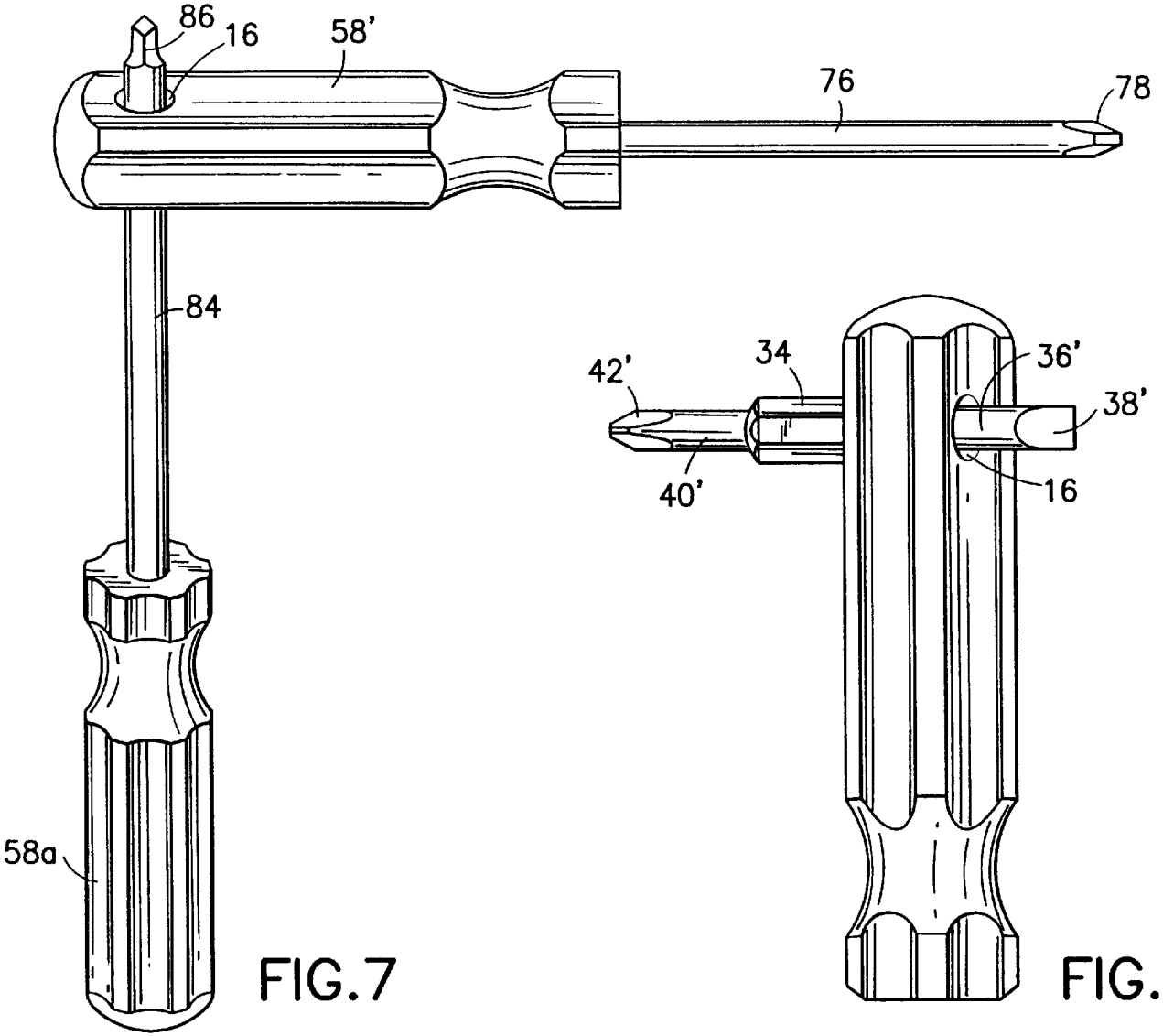
FIG. 6 illustrates a dual bit driver member of the kit illustrated in FIGS. 3A–3F being magnetized by the magnet (s) in the handle of the driving tool of the kit illustrated in FIG. 3E.
FIG. 7 illustrates one driver member of one driving tool of the kit illustrated in FIGS. 5A–5E being magnetized by the magnet(s) in the handle of the driving tool of the kit illustrated in FIG. 5B.

In FIG. 6, one of the dual bit elements 32' of FIG. 3B is shown extending through the aperture of hole within the handle 58' of FIG. 3E to magnetize the driver shaft 36' and the flat screwdriver blade 38'. Of course, if the Phillips tip 42' needed to be magnetized, it would be passed through the opening or space 16 as discussed in relation to FIG. 1. In FIG. 7, the manner of magnetizing the driver tip of a fixed driver shaft used with the kit shown in FIGS. 5A–5E, as shown, in which the driver shaft 84 of FIG. 5D is inserted through the space or opening 16 of the handle 58' of the related tool of the kit shown in FIG. 5B. Passage of the driver shaft through the opening or space 16 will, in this instance, magnetize the "TORX" tip 86.

It is clear that while a limited number of screwdrivers in each kit has been illustrated, numerous additional screwdrivers with various screwdriver tip configurations or terminations can be provided. In each instance, regardless of the nature of the screwdriver tip, each tip can be magnetized and/or magnetized by relying on the limited number of magnets on the handles of one or two of the handles of the tools of the kit.

It will be evident, therefore, that there are many possible arrangements of the magnets in order to practice the present invention. The specific locations of the magnets on the handle are not critical, and one single magnet or two spaced magnets may be used. However, in order to effectively practice the present invention, it is required or strongly desirable that the magnetic materials used have a relatively high energy product and that the magnetizable components can be positioned at or proximate to the magnetic axes of the magnets.

An important feature of the present invention is the provision of magnetic means on the handle for establishing a magnetizing magnetic field accessible for selective placement of a magnetizable element within the field, with the magnetic means being formed by a permanently magnetized material having an energy product sufficiently high so that the size and volume of the permanent magnet can be made sufficiently small so that it can be mounted on or embedded within conventionally sized handles, even the generally smaller handles associated and used with precision screwdrivers. Since the magnetic energy content, or BH product, of a magnetic material is proportional to the volume of the magnet, it has been determined that in order to use permanent magnets with small volumes to be mountable on driver tool handles, the magnetic properties of the permanent magnet materials must be equal to at least $7.0\times10^6$ gauss-oersteds. Magnetic flux lines conventionally leave the North Pole and enter the South Pole, the magnetic flux lines being always closed curves that leave the North Pole and enter the South Pole and always maintain the same direction. Therefore, magnetic flux lines generally exhibit the same directions at both Pole surfaces, with the exception that the flux lines leave from the North Pole and enter into the South Pole. The placement of a soft magnetizable material proximate to either of the polar surfaces, therefore, has the same effect on the magnetic domains of the magnetizable material and would tend to either magnetize or demagnetize the magnetizable material at each of the poles. Since both poles have the same effect on a magnetizable element, it is generally necessary to have at least two permanent magnets which are so arranged so as to provide oppositely directed magnetic fields in order to establish reverse polarizing effects on the magnetizable element. Thus, if one of the magnetic poles of one of the permanent magnets provides a magnetizing effect, the other permanent magnet is preferably so arranged so that the placement of the magnetizable element next to one of its poles will have an opposite or demagnetizing effect.

Because conventional magnetic materials that have been used in the past for magnetizing and demagnetizing have had relatively low energy products BH, they could not be embedded or mounted on conventional driver tool handles. Even when attempts to do so have been made, only single bulky and weak magnets could be provided which would normally serve to magnetize components. However, in accordance with the present invention, two or more magnets can now be easily mounted and/or embedded within conventional driver tool handles, even the relatively small precision screwdriver handles, to provide strong magnetizing and demagnetizing fields.

Figure 8:
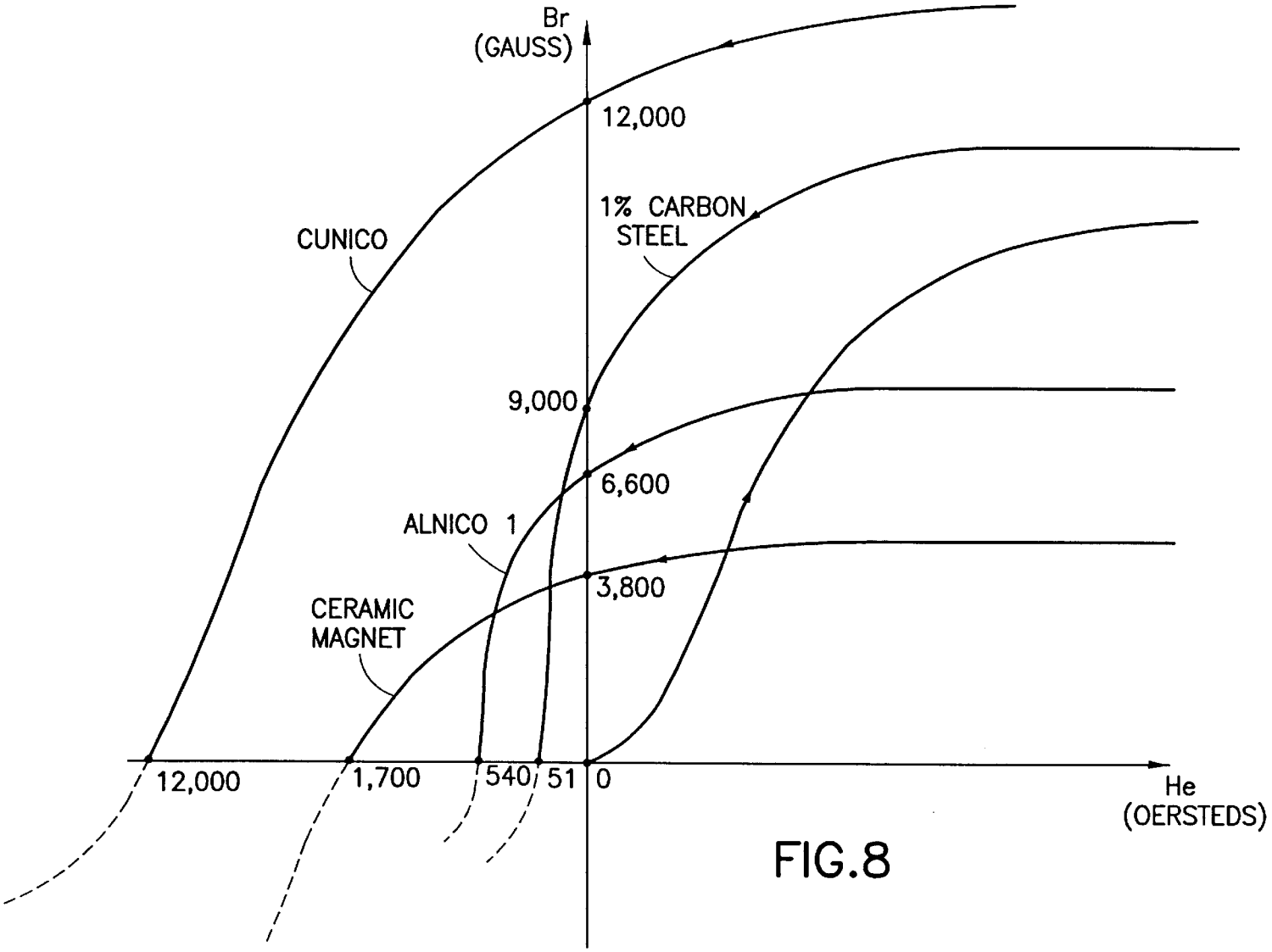
FIG. 8 illustrates partial magnetization curves for some typical or representative magnetizable materials, illustrating the magnetizing force required to initially saturate the magnetic materials and, subsequently, to demagnetize such materials.

Referring to FIG. 8, typical BH curves are illustrated for different magnetizable materials. In each case, with the magnetizable material initially totally demagnetized, the curve M illustrates initial magnetization from the origin, such that as the magnetic intensity H is increased, the flux levels within the materials B are correspondingly increased. While initially such relationship may be relatively linear, magnetic materials saturate at a predetermined level such that increases in magnetic intensity H do not result in additional flux being generated. The remaining curves D1, D2, D3 and D4 illustrate the demagnetizing portions of the B-H curves for different magnetizable materials, namely, cunico, 1% carbon steel, alnico and ceramic magnets. It will be evident that these materials not only have different retentive values $B_r$ (at H=0) but also require different amounts of reverse magnetization in order to totally demagnetize these materials or revert these to the totally demagnetized states in which B=0. Thus, cunico has a retentive field of 12,000 gauss when demagnetizing force is removed and requires −12,000 oersteds to totally demagnetize the material. One-percent carbon steel has a retentive magnetic field of 9,000 gauss when the magnetic intensity is removed, and requires only −51 oersteds to totally demagnetize such steel. Alnico has a somewhat lower retentive field of 6600 gauss, while requiring −540 oersteds to demagnetize the alnico, while a typical ceramic magnet has the lowest retentive field when magnetic intensity is removed, namely 3800 gauss, while a negative intensity of 1700 oersteds is required to demagnetize this material. Therefore, particularly for 1% carbon steel, alnico and ceramic magnets, it will be evident that the reverse magnetic intensities required to fully demagnetize these materials are relative low and substantially less than the intensities required to saturate and fully magnetize these materials. It is for this reason that the distances $d_1$ in each of the embodiments illustrated was selected to be less than the demagnetizing distances $d_2$.

While this invention has been described in detail with particular reference to preferred embodiments thereof, it will be understood that variations and modifications will be effected within the spirit and scope of the invention as described herein and as defined in the appended claims.

Figure 9:
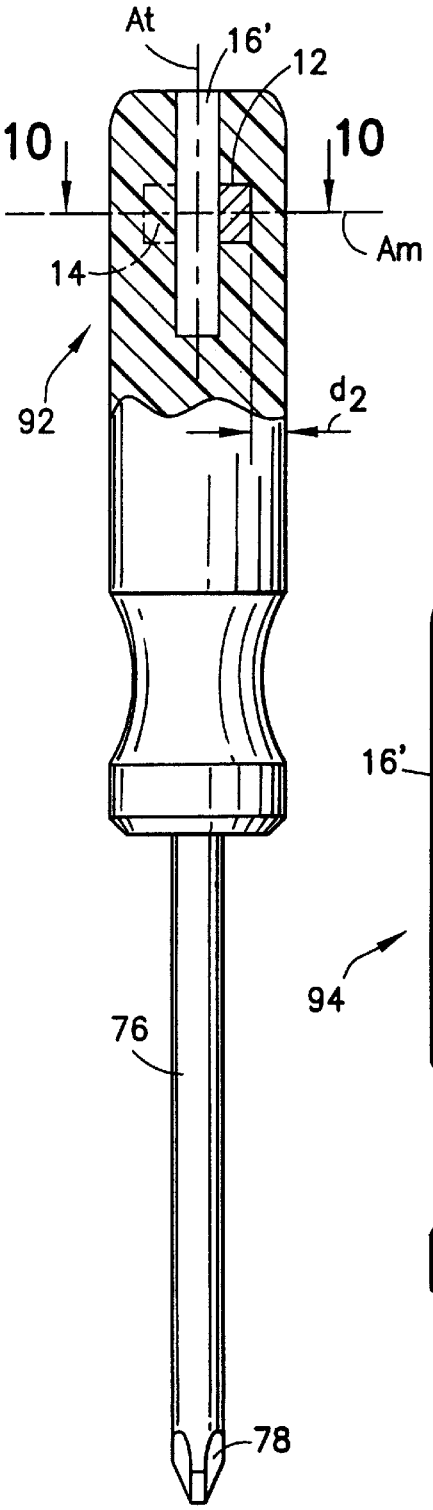
FIG. 9 is similar to FIG. 5A, the upper portion of the handle being in cross section, and showing further variation of the invention in which the opening or space within the handle for moving a tool driver tip adjacently to an embedded magnet is a longitudinal hole which is aligned with the axis of the handle of the tool.
Figure 10:
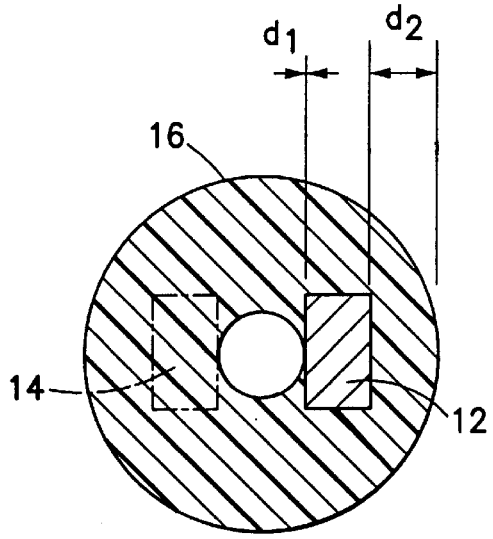
FIG. 10 is a cross sectional view of the handle shown in FIG. 9, taken along line 10—10.

Thus, for example, while the spaces or openings in the handle 16 have been shown in the prior disclosed embodiments as being generally transverse to the axis $A_t$ of the driver tool and handle thereof, it will be clear to those skilled in the art that the opening can be arranged or oriented in any direction. Thus, referring to FIG. 9, an elongate or longitudinal opening or hole 16' is shown which is arranged substantially coextensively with the driver tool axis $A_t$ which extends a predetermined distance from the upper or approximate end of the handle to the interior of the handle. Clearly, the longitudinal or axial length of the hole or space 16' should be adequate for insertion of a driver tip so that the remote tip of the driver shaft passes or extends past the magnet 12, as described in connection with FIG. 1. While the space or hole 16' may be longer, the maximum length thereof will be a function of a distance in which the fixed driver shaft 76 is embedded within the handle. FIG. 9 also shows the optional additional magnet 14 that can be arranged diametrically opposite to the magnet 12, as discussed previously. As best shown in FIG. 10, the magnets 12 and 14 can be placed adjacent to the hole or space 16' so that the distance $d_1$ is either 0, when the driver shaft inserted within the hole 16' has a diameter substantially the same of that of the hole, or the distance $d_1$ will be a finite quantity less than the distance $d_2$when the driver shaft inserted into the hole is somewhat smaller than the diameter of the hole. With this arrangement, the driver tools of the kit can be demagnetized by positioning or swiping the magnetized driver shaft in proximity to the magnetic axis $A_m$ of the magnet 12 or the magnets 12, 14.

Figure 11:
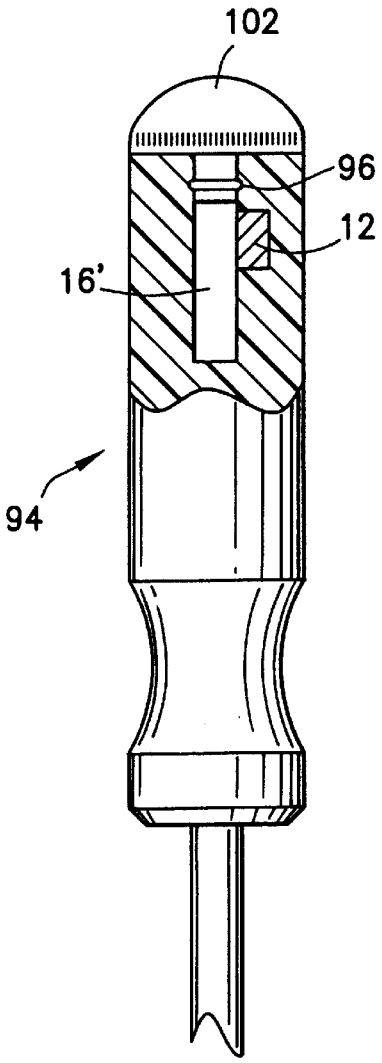
FIG. 11 is similar to FIG. 9, but showing the use of a single magnet to one side of the longitudinal hole or cavity and further illustrating a removable cap mounted with the axial hole.
Figure 12:
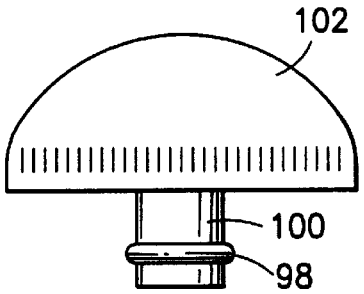
FIG. 12 is an enlarged side elevational view of the cap shown in FIG. 11.

In FIG. 11, a further embodiment 94 is illustrated in which the single magnet 12 is arranged proximate to the longitudinal hole or space 16', as in FIG. 9. However, in proximity to the free or open end of hole 16' there is provided an annular or circumferentially groove 96 to receive an annular protuberance or bead 98 provided on a plug 100 attached to a cap 102, shown enlarged in FIG. 12, the diameter of which substantially corresponds to the diameter of the handle. By making the bead somewhat deformable, the plug or post 100 can be forced into the hole or space 16' to a position shown in FIG. 11 in which the bead 98 is received within the annular groove 96. This renders the cap 102 rotatable on the handle. Once mounted on the handle as shown in FIG. 11, the cap covers the free end of the hole 16' and eliminates any sharp edges that might otherwise render the tool difficult or inconvenient to use. When any driver bit of the kit needs to be magnetized, the cap 102 can simply be removed to render the hole 16' accessible for insertion of the driver bit shaft. It should also be clear to those skilled in the art that while the openings or spaces 16, 16' have been shown oriented either in a direction transverse to the tool axis or coextensive therewith, the hole or space can also assume any angle intermediate between these two positions which are displaced from each other by 90°0. In such case, the magnets need simply be arranged on or both sides of the hole or space irrespective of its orientation or inclination.

What I claim is:

1. A hand-held driving tool kit comprising a plurality of hand-held driving tools each having an elongate handle defining a tool axis and being suitably shaped and dimensioned to be graspable within the hand of a user and a driver member mounted at one axial end of said handle and defining a driver axis generally co-axially aligned with said tool axis, at least one of said driving tools of said kit having at least one permanent magnet on said handle, said at least one magnet being formed of a magnetized material having north and south poles defining a magnetic axis generally arranged on said handle of said at least one driving tool to permit selective placement of a magnetizable element at at least one position along said magnetic axis at a predetermined distance from one of said poles to magnetize the element and placement of the element a distance greater than said predetermined distance from the other of said poles to demagnetize the element, said magnetic axis being either aligned with or offset from said driver axis, whereby driver members of at least some of the driving tools or a magnetizable element may be magnetized by positioning same adjacent to one of said poles and demagnetized by positioning the magnetizable element adjacent the other of said poles.

2. A hand-held driving tool kit as defined in claim 1, wherein said at least one magnet has an energy product equal to at least $7.0\times10^6$ gauss-oersteds.

3. A hand-held driving tool kit as defined in claim 1, wherein at least one permanent magznet comprises one permanent magnet provided on said at least one driving tool.

4. A hand-held driving tool kit as defined in claim 1, wherein at least one permanent magnet comprises two permanent magnets provided on said at least one driving tool.

5. A hand-held driving tool kit as defined in claim 1, wherein a hole is provided in said handle of said at least one driving tool sufficiently large to receive a magnetizable element to be magnetized, a permanent magnet being positioned adjacent to said hole to position a magnetizing pole in proximity to the magnetizable element when passed through said hole.

6. A hand-held driving tool kit as defined in claim 5, wherein said hole is generally aligned with said tool axis.

7. A hand-held driving tool kit as defined in claim 6, wherein said magnetic axis is offset by 90° from said tool axis.

8. A hand-held driving tool kit as defined in claim 7, wherein at least one permanent magnet comprises two magnets arranged on diametrically opposite sides of said hole and are arranged to form different distances to the demagnetizing poles at opposite sides of said handle.

9. A hand-held driving tool kit as defined in claim 6, wherein said magnetic axis is generally aligned with said driver axis.

10. A hand-held driving tool kit as defined in claim 9, wherein said handle has an external configuration to form a plurality of selectable demagnetizing distances with the demagnetizing pole surface.

11. A hand-held driving tool kit as defined in claim 1, wherein at least one permanent maget comprises one permanent magnet mounted on one driving tool of said kit to provide both of said north and south poles, whereby the driver members of said kit can be magnetized and demagnetized by said one permanent magnet.

12. A hand-held driving tool kit as defined in claim 1, wherein at least one permanent magnet comprises two permanent magnets provided each on another of said at least one driving tool, one of said permanent magnets being arranged to establish a magnetizing field and the other of said magnets being arranged to establish a demagnetizing field.

13. A hand-held driving tool kit as defined in claim 1, wherein a plurality of driving tools of said kit are provided with at least one permanent magnet on an associated handle, whereby at least some of said driver members of said kit can be magnetized or demagnetized by more than one magnet mounted on more than one of said handles.

14. A hand-held driving tool kit as defined in claim 1, wherein at least one permanent magnet comprises a single permanent magnet provided with its magnetic axis normal to said tool axis of said at least one driving tool, the magnetizing and demagnetizing pole surfaces being spaced from the lateral sides of said handle of said at least one driving tool which form surfaces against which the magnetizable element may be abutted.

15. A hand-held driving tool kit as defined in claim 1, wherein at least one permanent magnet comprises two spaced permanent magnets provided on said at least one driving tool with aligned magnetic axes and with pole surfaces facing each other having the same polarities.

16. A hand-held driving tool kit as defined in claim 1, wherein at least one permanent magnet comprises two spaced permanent magnets provided on said at least one driving tool with aligned magnetic axes and with pole surfaces facing each other having opposite polarities.

17. A hand-held driving tool kit as defined in claim 1, wherein at least one permanent magnet comprises two permanent magnets provided on said at least one driving tool having their magnetic axes substantially parallel to each other and with their pole surfaces of the same polarities facing the same directions along said magnetic axes.

18. A hand-held driving tool kit as defined in claim 1, further comprising spacer means made of non-magnetizable material on said at least one driving tool for positioning the magnetizable element a distance from the demagnetizing pole a distance greater than from the magnetizing pole.

19. A hand-held driving tool kit as defined in claim 1, wherein said handle of said at least one driving tool is provided with a free proximate end rotatably mounted about said tool axis, and said magnet is mounted on said rotatably mounted end.

20. A hand-held driving tool kit comprising a plurality of hand-held driving tools each having an elongate handle defining a tool axis and being suitably shaped and dimensioned to be graspable within the hand of a user; and a driver member mounted at one axial end of said handle and defining a driver axis generally co-axially aligned with said tool axis, and permanent magnet means on said handle of at least one of said driving tools, said magnet means having accessible north and south poles, said magnet means being arranged on said handle of said at least one of said driving tools to permit selective placement of a magnetizable element adjacent to each of said poles, whereby a magnetizable element may be magnetized by positioning same adjacent to one of said poles and demagnetized by positioning the magnetizable element adjacent to the other of said poles.

21. A hand-held driving tool kit comprising a plurality of hand-held driving tools each having an elongate handle defining a tool axis and being suitably shaped and dimensioned to be graspable within the hand of a user and a driver member mounted at one axial end of said handle and defining a driver axis generally co-axially aligned with said tool axis, at least one of said driving tools of said kit having at least one permanent magnet on said handle, said at least one magnet being formed of a magnetized material having north and south poles defining a magnetic axis generally arranged on said handle of said at least one driving tool to permit selective placement of a magnetizable element at at least one position along said magnetic axis at a predetermined distance from one of said poles to magnetize the element and placement of the element a distance greater than said predetermined distance from the other of said poles to demagnetize the element, said magnetic axis being either aligned with or offset from said driver axis, whereby driver members of at least some of the driving tools or a magnetizable element may be magnetized by positioning same adjacent to one of said poles and demagnetized by positioning the magnetizable element adjacent the other of said poles, said handle of said at least one driver tool being provided with a free proximate end rotatably mounted about said tool axis.

* * * * *